US007963391B2

(12) United States Patent
Weaver et al.

(10) Patent No.: US 7,963,391 B2
(45) Date of Patent: Jun. 21, 2011

(54) FLEXIBLE CARRIER

(75) Inventors: William N. Weaver, Northbrook, IL (US); Jason R. Moreau, Chicago, IL (US); Robert Olsen, Medinah, IL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 12/415,601

(22) Filed: Mar. 31, 2009

(65) Prior Publication Data

US 2009/0184009 A1 Jul. 23, 2009

Related U.S. Application Data

(63) Continuation of application No. 11/006,858, filed on Dec. 8, 2004, now Pat. No. 7,510,074.

(51) Int. Cl.
*B65D 75/00* (2006.01)

(52) U.S. Cl. ..... 206/150; 294/87.2

(58) Field of Classification Search ..... 206/147, 206/150–153, 158, 170, 427, 432; 294/87.2
See application file for complete search history.

(56) References Cited

U.S. PATENT DOCUMENTS

| | | | | |
|---|---|---|---|---|
| 4,367,841 | A | 1/1983 | Mazumdar | |
| 5,154,289 | A | 10/1992 | Van Erden | |
| 5,456,350 | A * | 10/1995 | Olsen et al. | 206/150 |
| 5,511,656 | A * | 4/1996 | Olsen | 206/150 |
| 5,653,334 | A * | 8/1997 | Marco | 206/150 |
| 5,806,667 | A * | 9/1998 | Marco | 206/150 |
| 5,962,092 | A | 10/1999 | Kuo et al. | |
| 6,006,902 | A * | 12/1999 | Weaver | 206/150 |
| 6,056,115 | A * | 5/2000 | Olsen | 206/150 |
| 6,122,893 | A * | 9/2000 | Weaver et al. | 53/48.4 |
| 6,170,225 | B1 | 1/2001 | Cervantes et al. | |
| 6,170,652 | B1 * | 1/2001 | Olsen | 206/150 |
| 6,234,945 | B1 * | 5/2001 | Weaver | 493/330 |
| 6,598,738 | B2 * | 7/2003 | Weaver | 206/150 |
| 7,074,476 | B2 * | 7/2006 | Weaver et al. | 206/150 |
| 7,195,809 | B2 | 3/2007 | Weaver et al. | |
| 2002/0011423 | A1 | 1/2002 | Weaver | |
| 2004/0192850 | A1 | 9/2004 | Weaver et al. | |

FOREIGN PATENT DOCUMENTS

| | | |
|---|---|---|
| EP | 0997389 | 5/2000 |

* cited by examiner

*Primary Examiner* — Luan K Bui

(74) *Attorney, Agent, or Firm* — Pauley Peterson & Erickson

(57) ABSTRACT

A flexible carrier for carrying a plurality of containers includes a flexible sheet and a plurality of container receiving apertures formed in the flexible sheet. An array of the container receiving apertures extend longitudinally across the flexible sheet wherein each container receiving aperture is substantially rectangular and includes an aperture perimeter that increases more than 42% following application to a container.

18 Claims, 6 Drawing Sheets

FLEXIBLE CARRIER

CROSS REFERENCE TO RELATED APPLICATION

This application is a continuation of U.S. patent application Ser. No. 11/006,858, filed 8 Dec. 2004, and issued as U.S. Pat. No. 7,510,074 on 31 Mar. 2009.

BACKGROUND OF THE INVENTION

1. Field of the Invention

This invention relates to a flexible carrier for carrying a plurality of containers such as bottles or cans.

2. Description of Prior Art

Conventional container carriers are often used to unitize a plurality of similarly sized containers, such as cans, bottles and/or similar containers that require unitization. Plastic ring carriers having a plurality of container apertures are one such conventional container carrier.

Conventional carriers include multi-packaging devices that engage the chime, rim or rib around the upper portion of the container, called "rim-applied carriers" or "RAC carriers". Another conventional carrier is the sidewall-applied carrier, called "SAC carriers," wherein the multi-packaging device engages the sidewall of the containers.

Flexible carriers are applied to containers by stretching the carrier around the diameter of the container, and allowing the stretched carrier to recover, providing a tight fit. The carrier is typically applied to the chime or rib, where this structure exists, or to the main sidewall.

Two modes of failure are common in existing carriers and limit the amount of stretch designed into such carriers. A first common mode of failure occurs if the container engaging portion of the carrier is stretched too much during application. As a result, the carrier may stretch beyond its yield strength and not adequately recover, a condition also called "neck down," leading to package failure. However, if the aperture is too large and the container engaging portion is not stretched enough, it may not develop enough tension to adequately engage the container, leading to package failure.

Another common mode of failure is caused by stress risers within the carrier created by notches or scratches within the otherwise smooth flexible carrier. Small notches or scratches may be formed during either the manufacturing process or when the carrier is passed over and against the containers. These notches, scratches or tears result in stress risers that propagate into larger tears due to the stresses placed on the carrier during application and/or by the weight of the package thereby causing failure such as a dislodged container.

Traditionally, efforts to avoid some of the above problems included minimizing stretch of the flexible carrier between a static condition and an applied condition around the respective containers. Accordingly, the bands surrounding the container receiving apertures (the "container engaging portions") of prior art carriers are not stretched greater than 15-41%. There is therefore a need or desire for a flexible carrier that uses less material and yet still exhibits improved recovery, improved elongation at application, improved stretch to yield and is less prone to tear when notched or scratched.

SUMMARY OF THE INVENTION

The present invention is directed to a flexible carrier for containers which utilizes less material and has smaller container receiving apertures and yet has improved recovery after stretch, improved elongation at application, and is more resistant to tearing when notched or scratched. The flexible carrier is preferably formed using a polymer blend and a configuration and geometry as described herein.

According to preferred embodiments of this invention, the flexible carrier for carrying a plurality of containers includes a flexible sheet and a plurality of container receiving apertures formed in the flexible sheet. An array of the container receiving apertures extend longitudinally across the flexible sheet wherein each container receiving aperture is substantially rectangular and includes an aperture perimeter that may increase greater than approximately 42%, suitably approximately 43-54% and more preferably approximately 46-53% following application to a container. By increasing the stretch of the flexible carrier, particularly the container engaging portions surrounding each container receiving aperture, more material of the flexible carrier is placed into contact with the vertical plane of the container thereby resulting in tighter gripping engagement with such container.

BRIEF DESCRIPTION OF THE DRAWINGS

The above-mentioned and other features and objects of this invention will be better understood from the following detailed description taken in conjunction with the drawings wherein.

DESCRIPTION OF PREFERRED EMBODIMENTS

Figure 1:
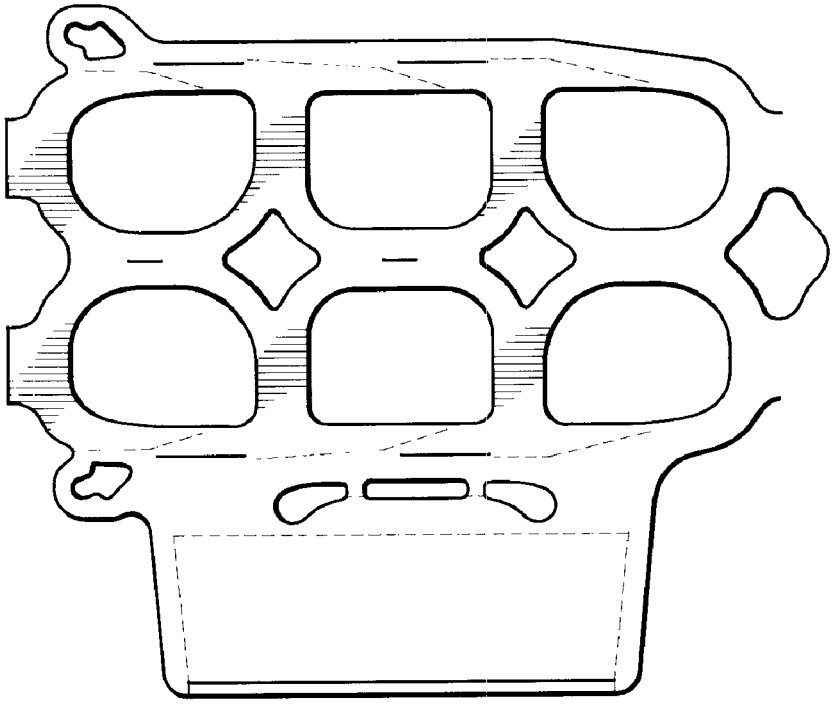
FIG. 1 PRIOR ART
FIG. 1 is a top view of a prior art container carrier.
Figure 2:
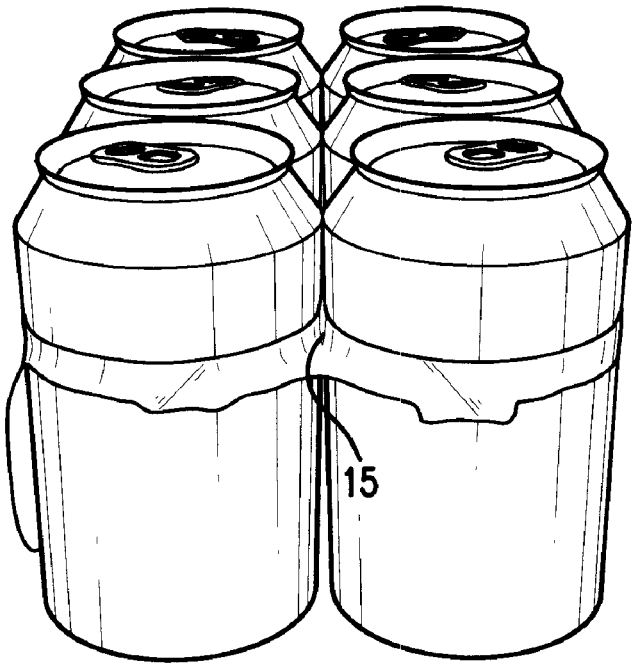
FIG. 2 PRIOR ART
FIG. 2 is a front view of a prior art package of containers.
Figure 3:
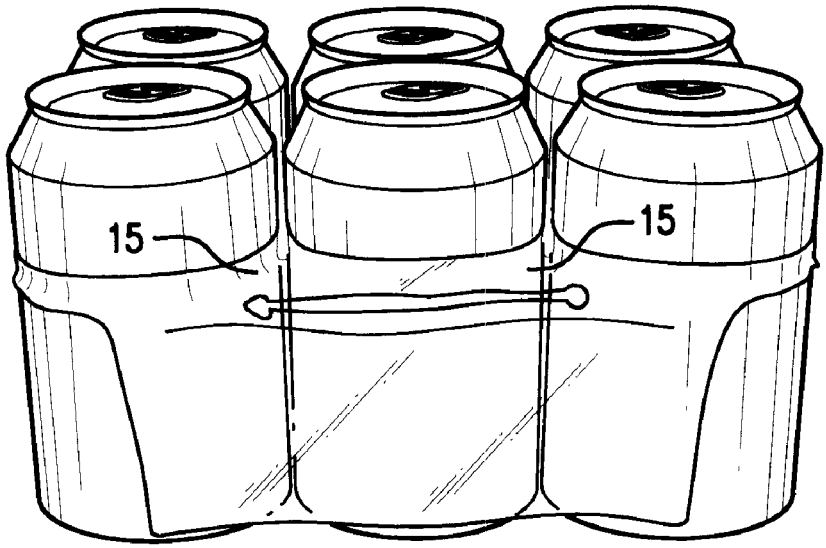
FIG.3 PRIOR ART
FIG. 3 is a side view of a prior art package of containers.

FIG. 1 shows a prior art container carrier for unitizing six containers. FIGS. 2 and 3 show a similar prior art container carrier as applied to six containers to form a unitized package. The prior art container carrier includes a plurality of container receiving apertures that are each stretched around a container to form a unitized package of containers. As described in more detail below, existing carriers include container receiving portions surrounding the container receiving apertures that stretch between 15% and 41% from a static, unstretched condition to an applied condition in stretching engagement with the respective container. This range of elongation is traditionally limited by failure modes including stretching or necking the carrier beyond yield and/or stress risers, such as notches or nicks, that result in tears or rips in the carrier following elongation.

Prior art packages, such as shown in FIGS. 2 and 3, generally exhibit horizontal regions 15 between containers that result from an uneven distribution of stress within the carrier thereby resulting in material that does not directly engage with the container. In other words, material within the carrier that is directly adjacent the container receiving apertures stretches more than material that is distant from the container receiving apertures. The horizontal regions 15 of material that result from such uneven distribution of stress within the carrier likely do not directly assist in the support and engagement of the respective containers.

Figure 4:
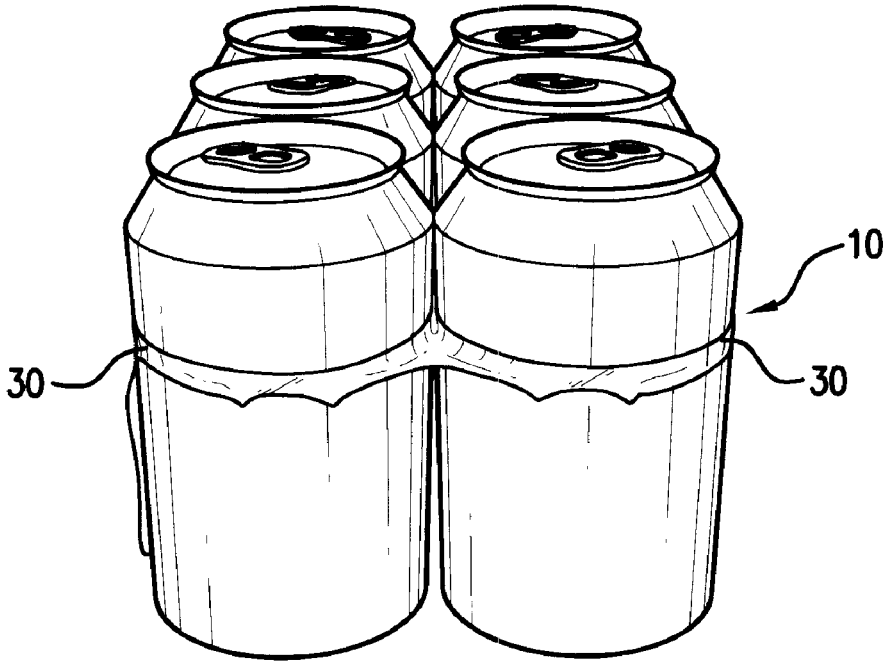
FIG. 4 is a front view of a package of containers using a container carrier according to one preferred embodiment of this invention.
Figure 5:
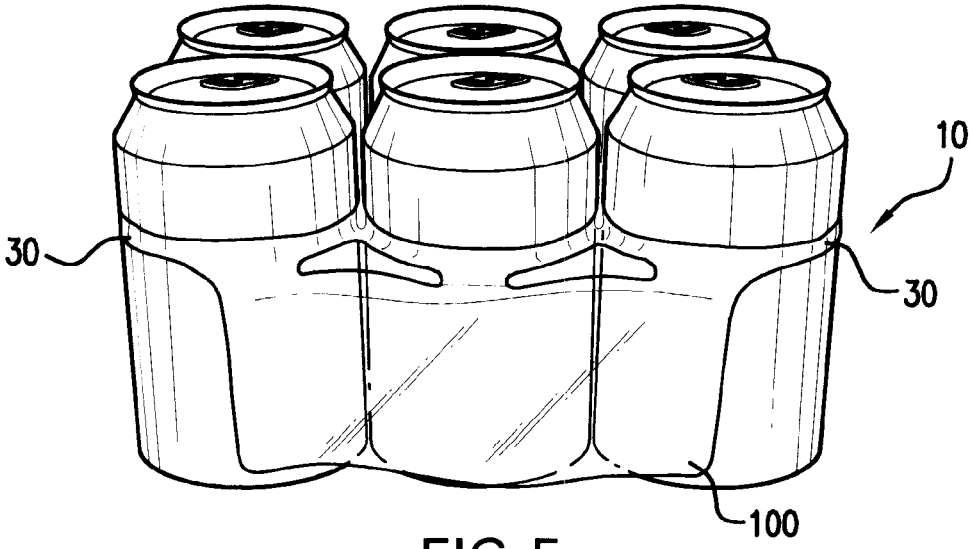
FIG. 5 is a side view of the package of containers shown in FIG. 4.

FIGS. 4 and 5 illustrate a package unitized with flexible carrier 10 according to this invention. FIGS. 4 and 5 demonstrate a substantial reduction in the horizontal regions 15 of material shown in the prior art package of FIGS. 2 and 3. As described in more detail below, portions of flexible carrier 10 are stretched a sufficient amount to permit a tight, gripping engagement with the containers. This tight, gripping engagement also maximizes the amount of material of the flexible carrier 10 positioned in the vertical plane, i.e., in contact with the sidewalls of the containers.

FIGS. 6-11 illustrate various structures for flexible carrier 10 of the invention. The illustrations are exemplary, and the invention is not limited to the flexible carriers 10 or packages shown. Each flexible carrier 10 preferably includes flexible sheet 20 defining a plurality of container receiving apertures 25, each for receiving a container. Flexible sheet 20 includes bands or rings of material, termed container receiving portions 30 herein, that surround each container receiving aperture 25. Such container receiving portions 30 stretchingly engage or grip the respective containers to form a unitized package of containers.

The containers, such as those shown in packages in FIGS. 4 and 5, are preferably cans. Although cans are shown in FIGS. 4 and 5, bottles or any other commonly unitized container may be used with flexible carrier 10 according to this invention. The containers are preferably like-sized within a single flexible carrier 10.

Figure 6:
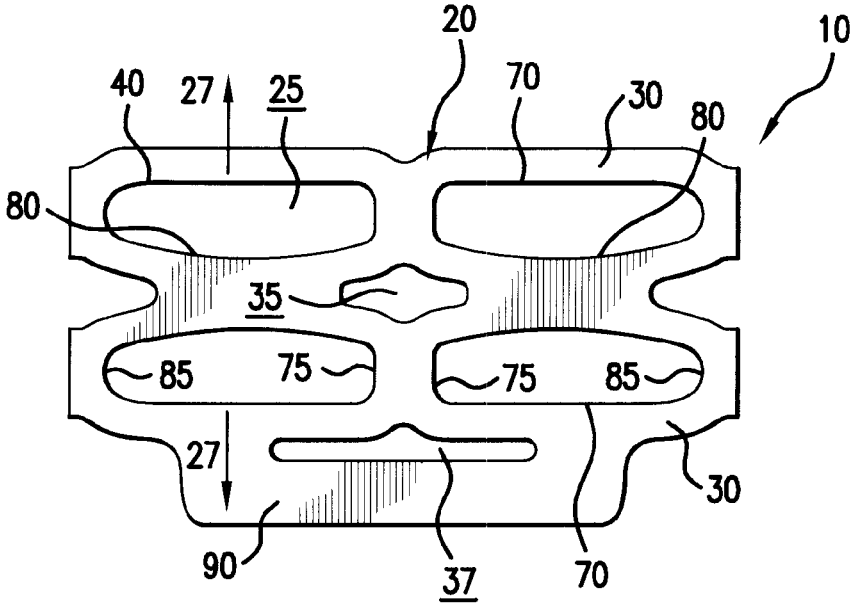
FIG. 6 is a top view of a flexible carrier for unitizing four containers according to one preferred embodiment of this invention.
Figure 7:
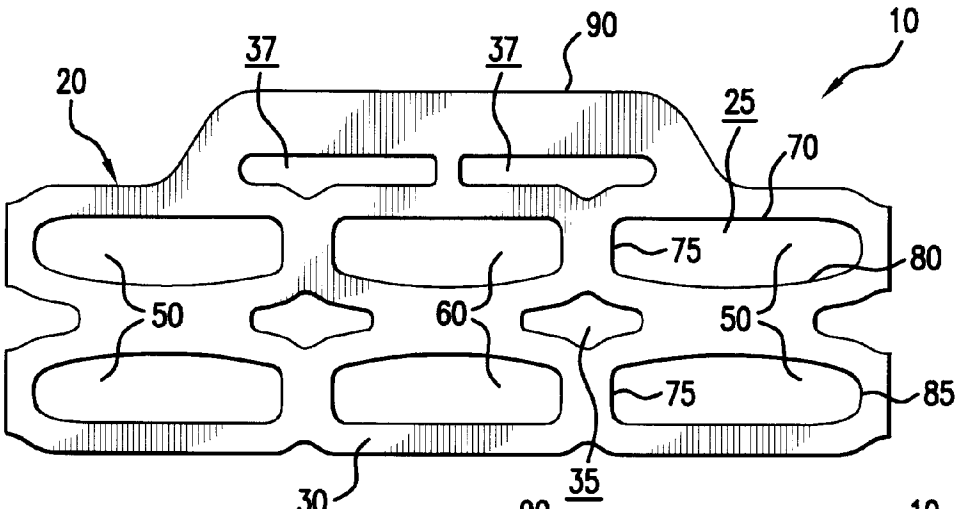
FIG. 7 is a top view of a flexible carrier for unitizing six containers according to one preferred embodiment of this invention.

Flexible sheet 20 of material is preferably cut, using means known to those skilled in the art, such as a stamping die, to form a plurality of container receiving apertures 25 in flexible sheet 20, such as shown in FIGS. 6-11. Container receiving apertures 25 are preferably formed in a rectangular shape extending longitudinally across flexible carrier 10 to sufficiently engage and retain a respective container. Container receiving apertures 25 preferably extend lengthwise or longitudinally along flexible sheet 20 so that a length of each rectangular container receiving aperture 25 is aligned longitudinally along flexible sheet 20 and a width of each rectangular container receiving aperture 25 is aligned transversely along flexible sheet 20. For example, in a six container or "six pack" arrangement such as shown in FIG. 7, flexible sheet 20 includes two longitudinal rows of three transverse pairs or ranks of container receiving apertures 25. Flexible sheet 20 may include other configurations of container receiving apertures 25 depending on the size of package and/or the number of containers desired. Specifically, according to a preferred embodiment of this invention, flexible sheet 20 includes a plurality of container receiving apertures 25 having a preferred geometry as described in more detail below.

Flexible carrier 10 is preferably manufactured so that raw carrier stock includes a generally continuous roll of flexible sheet 20 having a plurality of adjacent flexible carriers 10 that are punched and then wound onto a reel or spool (not shown) having several thousand flexible carriers 10, each flexible carrier 10 attached to each adjacent flexible carrier 10. As a result of the geometry of flexible carrier 10, particularly the elongated rectangular shape of each container receiving aperture 25, flexible carrier 10 is narrow enough to permit punching of at least one additional lane of carrier stock within each continuous roll of stock flexible sheet material. As such, numerous continuous, longitudinal lanes of carrier stock may be punched simultaneously in transversely adjacent rows. Flexible carriers 10 are later applied to containers to form packages and, during such process, are preferably unwound from the reels, stretched over the containers, cut at selected points to separate and then separated from each other to form individual packages.

Containers are positioned in each container receiving aperture 25 using a conventional packaging machine known to those having ordinary skill in the art. Weaver et al., U.S. Pat. No. 6,122,893, and Cervantes et al., U.S. Pat. No. 6,170,225, each describe various features of a packaging machine suitable for use with the subject invention and such references are hereby incorporated by reference. Preferably, the packaging machine, also called an applicating machine, includes a drum having a plurality of jaw pairs that engage each adjacent pair of container receiving apertures 25 and transversely stretch flexible sheet 20 so as to engage each container receiving aperture 25 with each container, specifically about a sidewall of such container.

Secondary apertures 35 may also be provided between and among container receiving apertures 25. As shown in FIGS. 6-11, secondary apertures 35 are generally diamond-shaped and preferably follow the contour of the adjacent container receiving apertures 25. Secondary apertures 35 may be used to carry the package formed by flexible carrier 10 once the containers have been inserted into container receiving apertures 25. Secondary apertures 35 may be used to reduce material cost, and to control or modify the size and stretching properties of container receiving portions 30.

The containers to be inserted in container receiving apertures 25 may be bottles or cans having varying shapes and diameters. Referring to FIGS. 4 and 5, for instance, each flexible carrier 10 is installed on containers by stretching the container receiving portions 30 in the cross direction, in opposing fashion, as indicated by arrows 27 shown in FIG. 6. Carrier receiving portions 30 are installed around the respective containers while stretched, and are allowed to retract or recover to provide a snug fit around the rib, chime or outside sidewall surface of the respective containers.

As used herein, the percentage change in size for container receiving aperture 25 from a static condition to an applied condition is measured by comparing a perimeter length of container receiving aperture 25 at rest (x) with a perimeter length of container receiving aperture 25 following application to a container (y). The resultant increase or delta is stated as a percentage, that is, $((y-x)/x)\times 100\%$.

Prior Art Carrier Stretch

As briefly described above, two traditional configurations of container carrier to container are the sidewall-applied carrier (SAC) position and the rim-applied carrier (RAC) position. A sidewall-applied carrier requires that the carrier is applied lower along the container than the rim-applied carrier. Sidewall-applied carriers, such as shown in FIGS. 1-3, generally include container receiving apertures having perimeters that stretch 15-41% from a static condition to an applied condition.

In particular, the sidewall-applied carrier shown in FIG. 1 includes container receiving apertures that stretch 20-30% depending upon the relative location of the container receiving aperture within the sidewall-applied carrier. For example, the sidewall-applied carrier shown in FIG. 1 includes a container receiving aperture (in the outer pairs of apertures) having a perimeter that stretches up to 30%.

Rim-applied carriers generally include container receiving apertures having perimeters that stretch 20-30%. For example, a common rim-applied carrier includes container receiving aperture perimeters that are applied to containers resulting in an elongation from a static condition to an applied condition of 20%.

Preferred Embodiment Carrier Stretch

Flexible carrier 10 for carrying a plurality of containers according to a preferred embodiment of this invention includes an array of container receiving apertures 25 extending longitudinally across flexible sheet 10 that each include an aperture perimeter 40 that may increase greater than approximately 42%, suitably approximately 43-54% and more preferably approximately 46-53% following application to the container.

In particular, FIG. 6 shows flexible carrier 10 for unitizing four containers. Flexible carrier 10 according to this embodiment of the invention includes container receiving apertures 25 having aperture perimeters of approximately 5.45 inches. Application of flexible carrier 10 to sidewalls of containers having a container circumference or perimeter of 8.2 inches results in stretch of approximately 50%.

FIG. 7 shows flexible carrier 10 for unitizing six containers. Flexible carrier 10 according to this embodiment of the invention includes outer transverse pairs 50 of container receiving apertures 25 having aperture perimeters of 5.6 inches and inner transverse pairs 60 of container receiving apertures 25 having aperture perimeters of approximately 5.3 inches. Each container receiving aperture 25 is applied to a container having a container circumference of 8.2 inches resulting in stretch of between approximately 46% and 54%.

Figure 8:
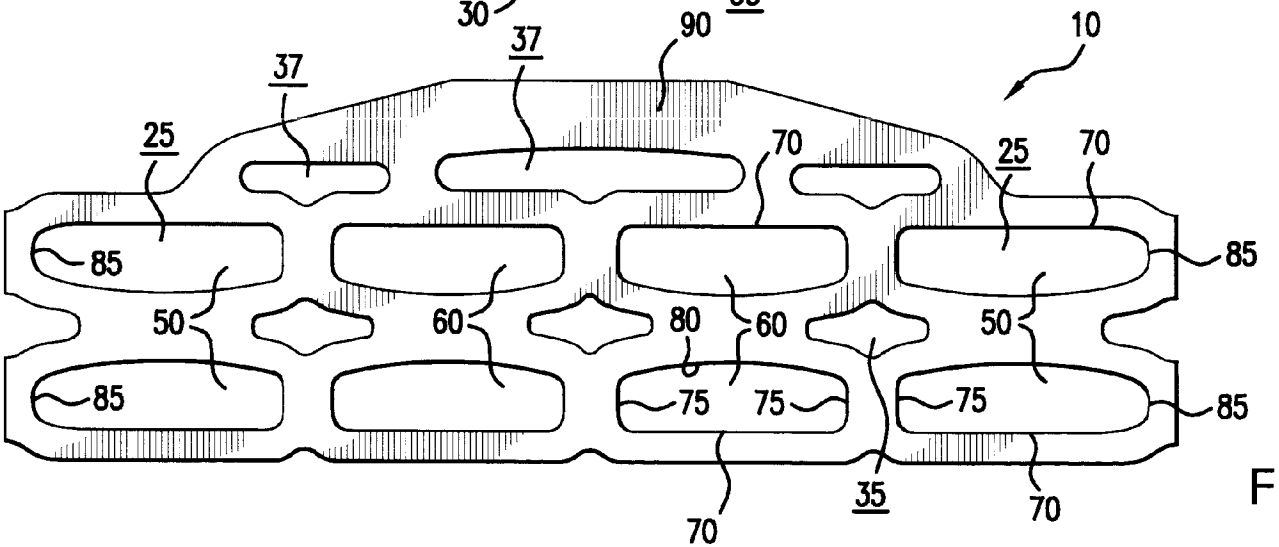
FIG. 8 is a top view of a flexible carrier for unitizing eight containers according to one preferred embodiment of this invention.

FIG. 8 shows flexible carrier 10 for unitizing eight containers. Flexible carrier 10 according to this embodiment of the invention includes outer transverse pairs 50 container receiving apertures 25 having aperture perimeters of 5.7 inches and inner transverse pairs 60 of container receiving apertures 25 having aperture perimeters of approximately 5.3 inches. Each container receiving aperture 25 is applied to a container having a container circumference of 8.17 inches resulting in stretch of between approximately 43% and 54%.

As described, container receiving apertures 25 are rectangular and include a lengthwise or longitudinal axis that extends longitudinally with flexible carrier 10. As shown in FIGS. 6-11, each rectangular container receiving aperture 25 includes a longitudinal axis that is 3-4 times longer than a corresponding width, more preferably 3.2-3.9 times longer than wide and most preferably 3.4-3.7 times longer than wide. As suggested by the above measurements and shown in FIGS. 6-11, container receiving apertures 25 extend longitudinally in transverse pairs across flexible sheet 10 and each container receiving aperture 25 in outer transverse pairs 50 of container receiving apertures 25 is longer in the longitudinal direction and across the longitudinal axis than each container receiving aperture 25 in inner transverse pairs 60 of container receiving apertures 25.

In addition, according to a preferred embodiment of this invention shown in FIGS. 6-11, container receiving apertures 25 are arranged and configured so that a straight perimeter section 70 extends longitudinally along outer edges of each container receiving aperture 25 and an arcuate perimeter section 80 extends longitudinally along inner edges of each container receiving aperture 25. In a transverse direction of each flexible carrier 10, a straight perimeter section 75 extends transversely along both edges of each inner transverse pair 60 of container receiving apertures 25 and an arcuate perimeter section 80 extends transversely along outer edges of each outer transverse pair 50 of container receiving apertures 25.

Each corner of each container receiving aperture 25 includes a radiused transition between adjoining section, even between two connecting straight perimeter sections 70, 75. Such radiused transitions avoid stress risers that may introduced in abrupt, right angle corners that are otherwise present in a generally rectangular geometry.

As a result of the above described geometry and the characteristics of flexible sheet 20, flexible carrier 10 includes a lesser amount of material than prior art carriers. In addition, flexible carrier 10 according to this preferred embodiment of the invention include container receiving portions 30 that, following engagement with containers, are generally positioned in a vertical plane relative to the containers and generally avoid an excess of material in horizontal regions 15 found in the prior art, such as FIGS. 2 and 3. By improving the elongation at container receiving portions 30 and throughout flexible carrier 10, the material approaches yield while maintaining a tight engagement with each respective container. The resulting package, shown in FIGS. 4 and 5, is compact and tight, without excess material in the horizontal plane, and includes container receiving portions 30 that tightly engage with the sidewalls of the respective containers.

As shown in FIGS. 6-8, flexible carrier 10 may further include an integral handle 90 extending longitudinally along one side of flexible sheet 20. According to this embodiment of the invention, one or more handle apertures 37 are positioned between handle 90 and the remainder of flexible sheet 20. Handle aperture 37 preferably includes a notch or indentation extending between each container receiving aperture 25 positioned within flexible sheet 20. Handle aperture 37 both provides a void within which to grasp resulting package and permits a flexible interface between handle 90 and remainder of flexible sheet 20.

Figure 9:
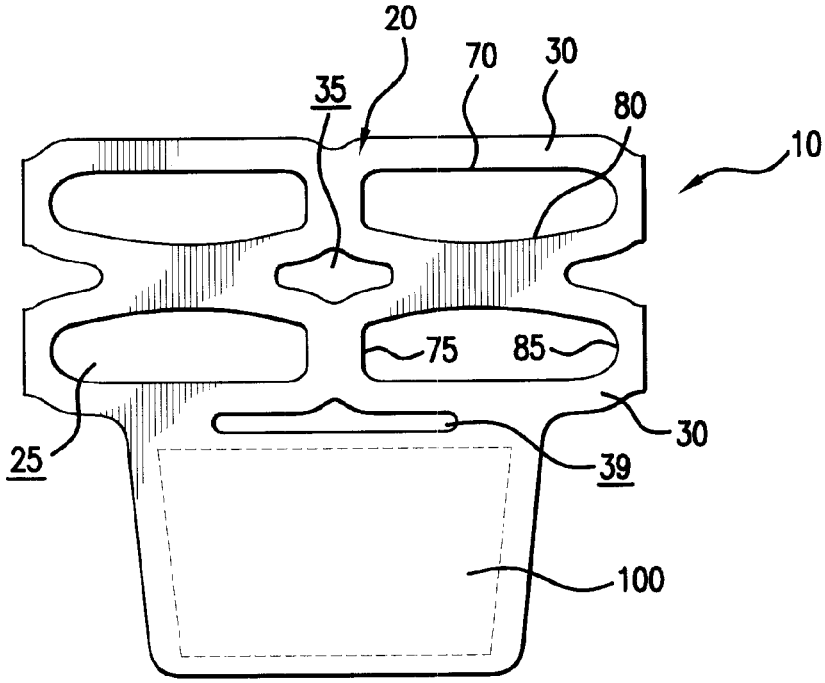
FIG. 9 is a top view of a flexible carrier for unitizing four containers according to one preferred embodiment of this invention.
Figure 10:
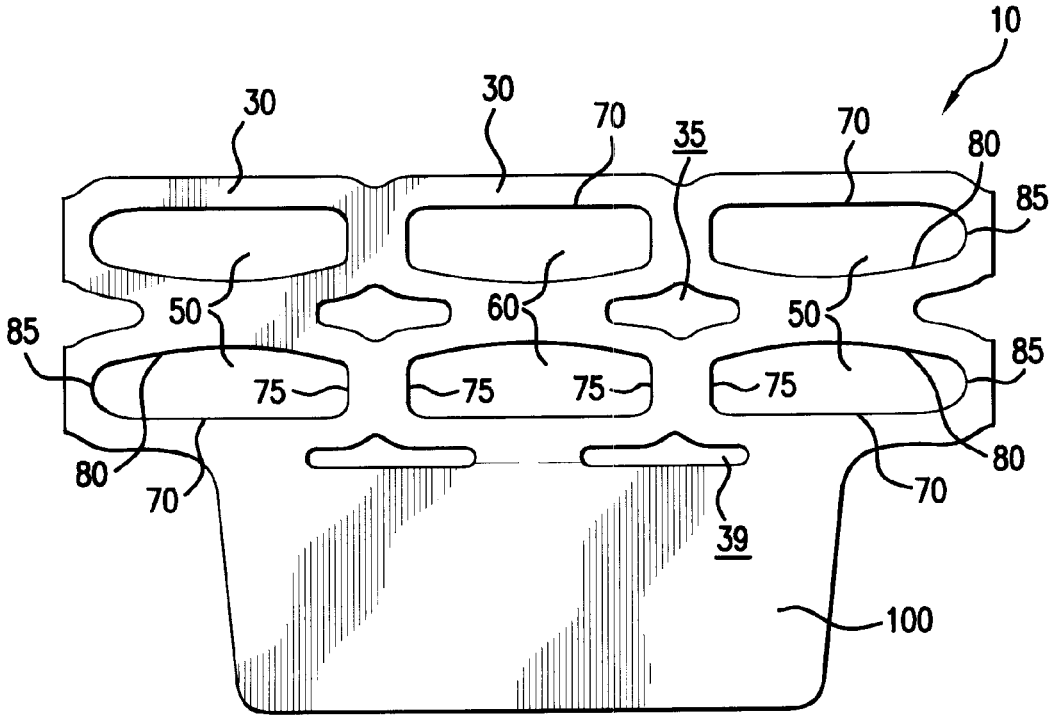
FIG. 10 is a top view of a flexible carrier for unitizing six containers according to one preferred embodiment of this invention.
Figure 11:
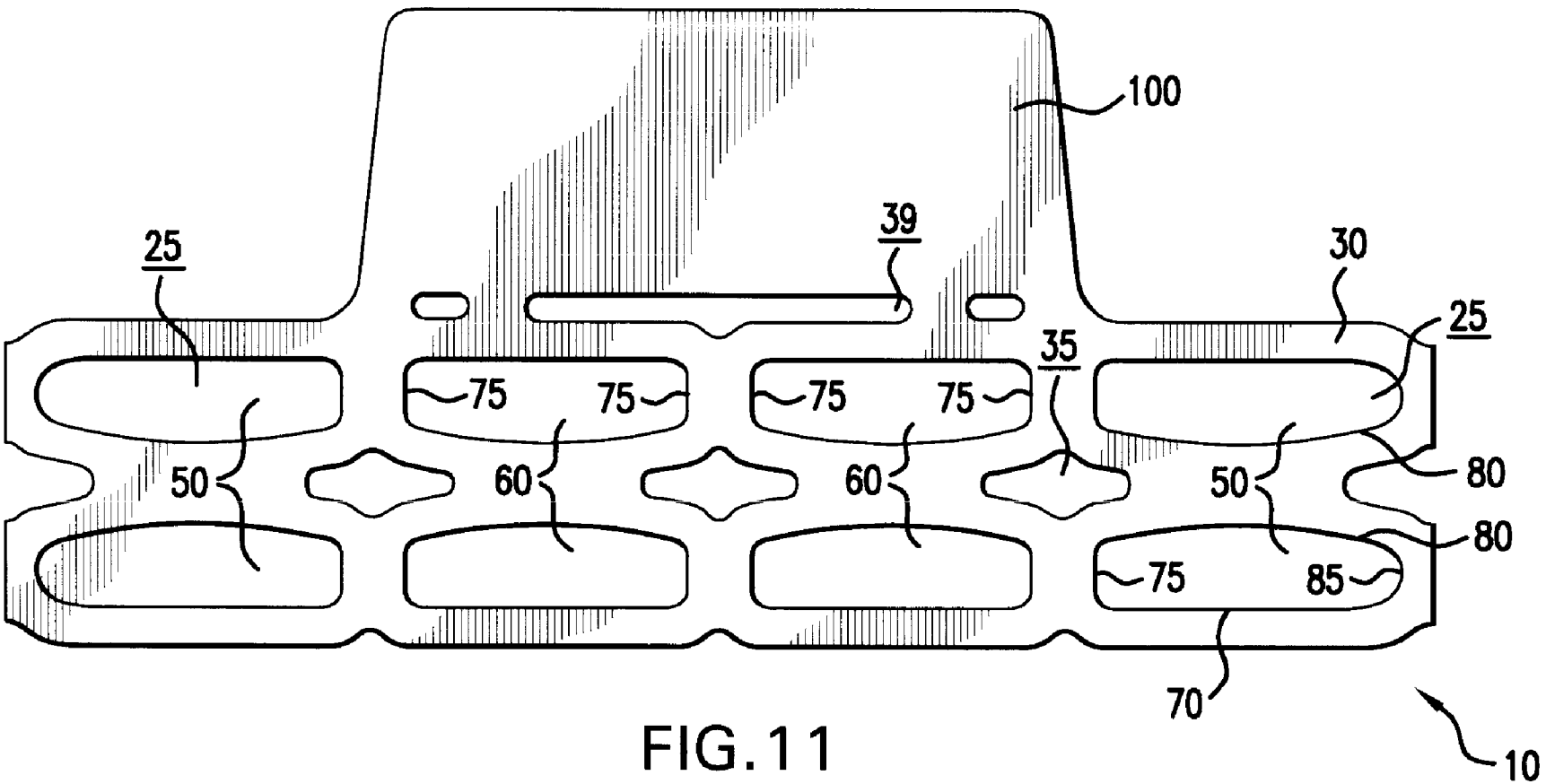
FIG. 11 is a top view of a flexible carrier for unitizing eight containers according to one preferred embodiment of this invention.

As shown in FIGS. 9-11, flexible carrier 10 may further or alternatively include an integral display panel 100 extending longitudinally along one side of flexible sheet 20. Display panel 100 may include printed advertising or billboard space, either directly applied to flexible sheet 20 or applied with an adhesive label, such as shown in FIG. 5. According to this embodiment of the invention, one or more panel apertures 39 are preferably positioned between display panel 100 and remainder of flexible sheet 20. Panel aperture 39 preferably includes a notch or indentation extending between each container receiving aperture 25 positioned within flexible sheet 20. Panel apertures 39 preferably urge display panel 100 into a generally vertical alignment with the vertical sidewalls of the containers within package.

The flexible sheet 20 used to form the flexible carrier 10 is desirably a polymeric or plastic sheet, which can be formed by an extrusion process and then cut to form flexible carrier 10. The flexible sheet 20 has a thickness which provides sufficient structural integrity to carry a desired number of containers. For instance, each flexible carrier 10 may be designed to carry two, four, six, eight, ten or twelve containers of a desired product having a specific weight, volume, shape and size. For most applications, the flexible sheet 20 may have a thickness of about 3-50 mils, suitably about 5-30 mils, commonly about 10-20 mils.

Flexible sheet 20 used to form flexible carrier 10 is formed using a polymer composition that preferably includes a high pressure low density polyethylene polymer and a single-site catalyzed ethylene-alpha olefin plastomer, such as metallocene, and such as taught in U.S. Ser. No. 10/762,202 for FLEXIBLE CARRIER and which is incorporated herein by reference. Such a composition preferably provides carrier 10 with improved recovery after stretch, improved elongation and strength at application, and improved resistance to tearing when the carrier is notched or scratched, compared to an otherwise similar carrier made using the high pressure low density polyethylene polymer alone.

While in the foregoing specification this invention has been described in relation to certain preferred embodiments thereof, and many details have been set forth for purpose of illustration, it will be apparent to those skilled in the art that carrier 10 and the related method of manufacture are susceptible to additional embodiments and that certain of the details described herein can be varied considerably without departing from the basic principles of the invention.

The invention claimed is:

1. A flexible carrier for carrying a plurality of generally cylindrical containers, comprising a flexible sheet of polymer material and a plurality of container receiving apertures formed between outer bands and inner bands in the flexible sheet, each container receiving aperture for receiving a container, the flexible carrier comprising:

an array of the container receiving apertures arranged in transverse pairs extending across the flexible sheet wherein each container receiving aperture is generally rectangular with a longitudinal axis 3-4 times longer than a corresponding width and further includes an aperture perimeter that increases more than 42% following application to the container and, after recovery, provides a snug fit around the container, and a width of each inner band of the inner bands between each container receiving aperture in a transverse pair is greater than half the width of each container receiving aperture and wider than a width of each outer band of the outer bands, wherein a straight perimeter section extends transversely along both edges of each inner transverse pair of container receiving apertures and an arcuate perimeter section extends transversely along outer edges of each outer transverse pair of container receiving apertures; and wherein the entire flexible sheet is a generally uniform and continuous extrusion of the polymer material.

2. The flexible carrier of claim 1 wherein the container receiving apertures comprise:

a straight perimeter section extending longitudinally along outer edges of each container receiving aperture; and an arcuate perimeter section extending longitudinally along inner edges of each container receiving aperture.

3. The flexible carrier of claim 1 wherein the aperture perimeter increases more than 50% following application to the container.

4. The flexible carrier of claim 1 wherein the container receiving apertures each include a longitudinal axis that extends longitudinally across the flexible sheet and wherein the container receiving apertures are arranged in transverse pairs across the flexible sheet and container receiving apertures in outer transverse pairs of container receiving apertures are longer across the longitudinal axis than container receiving apertures in inner transverse pairs of container receiving apertures.

5. The flexible carrier of claim 1 wherein the rectangular container receiving aperture includes a longitudinal axis 3.4-3.7 times longer than a corresponding width.

6. The flexible carrier of claim 1 wherein the flexible sheet comprises a polymer composition of a high pressure low density polyethylene polymer and a single-site catalyzed ethylene-alpha olefin plastomer.

7. A flexible carrier for carrying a plurality of containers, comprising a flexible sheet and a plurality of container receiving apertures formed between outer bands and inner bands in the flexible sheet, each container receiving aperture for receiving a container, the flexible carrier comprising:

an array of the container receiving apertures extending longitudinally in transverse pairs across the flexible sheet, wherein at least one container receiving aperture includes a substantially rectangular perimeter with a longitudinal axis 3-4 times longer than a width prior to stretching engagement with the container and a substantially circular perimeter at least 50% greater than the substantially rectangular perimeter following stretching engagement with the container and, after recovery, provides a snug fit around the container, and a width of the inner bands between each container receiving aperture in a transverse pair is greater than half the width of each container receiving aperture and wider than a width of the outer bands;

wherein, the container receiving apertures include a straight perimeter section extending longitudinally along outer edges of each container receiving aperture and an arcuate perimeter section extending longitudinally along inner edges of each container receiving aperture; and wherein the flexible sheet comprises a polymer composition of a polyethylene polymer and a plastomer.

8. The flexible carrier of claim 7 wherein the plastomer comprises a single-site catalyzed ethylene-alpha olefin plastomer.

9. The flexible carrier of claim 7 wherein the entire flexible sheet is generally homogeneous and comprises a continuous extrusion of the polymer material.

10. The flexible carrier of claim 7 wherein container receiving apertures in outer transverse pairs of container receiving apertures are longer than container receiving apertures in inner transverse pairs of container receiving apertures.

11. The flexible carrier of claim 7 further comprising:

a straight perimeter section extending transversely along both edges of each inner transverse pair of container receiving apertures; and an arcuate perimeter section extending transversely along outer edges of each outer transverse pair of container receiving apertures.

12. The flexible carrier of claim 7 wherein the rectangular container receiving aperture includes a longitudinal axis 3.4-3.7 times longer than a corresponding width.

13. The flexible carrier of claim 7 wherein at least one container receiving aperture of the plurality of container receiving apertures stretches a different percentage than at least one other container receiving aperture of the plurality of container receiving apertures.

14. A flexible carrier for application to a plurality of containers such that the containers may thereby be collectively carried by the carrier, the carrier comprising:

a flexible sheet including inner bands and outer bands defining a plurality of container-receiving apertures having an unapplied perimeter as measured prior to being applied to the plurality of containers and an applied perimeter as measured after being applied to the plurality of containers, wherein the applied perimeter is at least 42% greater than the unapplied perimeter said flexible sheet serving to collectively carry said plurality of containers after being applied thereto and, after recovery, providing a snug fit around the container, wherein the entire flexible sheet is generally homogenous and comprises a continuous extrusion of the polymer material;

wherein the container receiving apertures are generally rectangular and extend longitudinally in transverse pairs across the flexible sheet where each container receiving aperture is 3-4 times longer than wide, and a width of the inner bands between each container receiving aperture in a transverse pair is greater than half the width of each container receiving aperture and wider than a width of the outer bands; and wherein the container receiving apertures comprise:

a straight perimeter section extending longitudinally along outer edges of each container receiving aperture; and an arcuate perimeter section extending longitudinally along inner edges of each container receiving aperture.

15. The flexible carrier of claim 14 wherein said applied perimeter is between 46% and 53% greater than said unapplied perimeter.

16. The flexible carrier of claim 14 wherein said flexible sheet comprises a polymer composition of a high-pressure low-density polyethylene polymer and a single-site catalyzed ethylene-alpha olefin plastomer.

17. The flexible carrier of claim 14 wherein the generally rectangular container receiving aperture includes a longitudinal axis 3.4-3.7 times longer than a corresponding width.

18. A flexible carrier for carrying a plurality of generally cylindrical containers, comprising a flexible sheet of polymer material and a plurality of container receiving apertures formed between outer bands and inner bands in the flexible sheet, each container receiving aperture for receiving a container, the flexible carrier comprising:

an array of the container receiving apertures arranged in transverse pairs extending across the flexible sheet wherein each container receiving aperture is generally rectangular with a longitudinal axis 3-4 times longer than a corresponding width and further includes an aperture perimeter that increases more than 50% following application to the container and, after recovery, provides a snug fit around the container, and a width of each inner band of the inner bands between each container receiving aperture in a transverse pair is greater than half the width of each container receiving aperture and wider than a width of each outer band of the outer bands, wherein the container receiving apertures include a straight perimeter section extending longitudinally along outer edges of each container receiving aperture;

an arcuate perimeter section extending longitudinally along inner edges of each container receiving aperture;

a straight perimeter section extending transversely along both edges of each inner transverse pair of container receiving apertures; and an arcuate perimeter section extends transversely along outer edges of each outer transverse pair of container receiving apertures; and wherein the entire flexible sheet is a generally uniform and continuous extrusion of the polymer material.

* * * * *